US008927836B1

(12) United States Patent
Birkhamshaw

(10) Patent No.: US 8,927,836 B1
(45) Date of Patent: Jan. 6, 2015

(54) ADJUSTABLE AND REMOVABLE STRING INSTRUMENT NECK

(71) Applicant: Gary Upton Birkhamshaw, Mystic, CT (US)

(72) Inventor: Gary Upton Birkhamshaw, Mystic, CT (US)

( * ) Notice: Subject to any disclaimer, the term of this patent is extended or adjusted under 35 U.S.C. 154(b) by 0 days.

(21) Appl. No.: 14/120,759

(22) Filed: Jun. 25, 2014

(51) Int. Cl.
*G10D 3/00* (2006.01)
*G10D 3/06* (2006.01)

(52) U.S. Cl.
CPC ..... *G10D 3/06* (2013.01)
USPC ..... 84/293

(58) Field of Classification Search
USPC ..... 84/267, 290, 293
See application file for complete search history.

(56) References Cited

U.S. PATENT DOCUMENTS 7,705,224 B1 * 4/2010 Ward ..... 84/267
8,273,974 B1 * 9/2012 Gonzalez ..... 84/293

* cited by examiner

*Primary Examiner* — Kimberly Lockett
(74) *Attorney, Agent, or Firm* — Robert deGroot

(57) ABSTRACT

This system provides an acoustic string instrument that allows a musician to carefully adjust the height of the fingerboard relative to the body of the instrument by means of two slidable machined inserts that are inserted into the neck and body of the instrument. The inserts are adjusted by a hex wrench inserted into the back of the body of the instruments. The neck can also be completely removed by disengaging the inserts for transport.

9 Claims, 2 Drawing Sheets

ADJUSTABLE AND REMOVABLE STRING INSTRUMENT NECK

BACKGROUND OF THE INVENTION

Field of the Invention

This invention relates to a system for adjusting the height of the instrument neck above the body of a stringed instrument such as a violin, viola, cello, bass violin and other string instruments.

Description of the Prior Art

Patent Application Publication No. 2007/0107579 disclosed a stringed musical instrument such as a guitar and allows the user to change the vertical height of the instruments neck without affecting the angle of the neck relative to the guitar body. It is not specifically designed to have a removable neck but it might be possible by inserting a screw driver in the access hole below the strings on a guitar which might have a large enough access hole. Movement of the neck relative to the body is accomplished by inserting a tool in the back of the body and rotating the tool. This rotation turns a height adjustment screw which is held captive by a trap plate fastened to the back of the body of the instrument. Since the violin family does not have a large access hole in the body of the instrument, complete removal of the neck from the body is not possible in these instruments.

There are many musical string instrument patents that describe removal of the neck from the body, mostly guitar patents, but none describe a mechanism that both adjusts the neck and allows complete removal. Examples of this type of patent include U.S. Pat. No. 5,469,770, U.S. Pat. No. 7,208,664, U.S. Pat. No. 7,476,790 and Patent Publication No. 2,0006/6144209.

SUMMARY OF THE INVENTION

This adjustment mechanism which consists of a T-rail and U-joint provides for movement of the neck relative to the body and also complete removal of the neck from the body by turning a hex wrench which is inserted in the back of the body of a string instrument. The T-rail of this adjustment mechanism is firmly attached to the lower portion of the neck. It is connected directly to a tongue member that is attached to the neck of the instrument. The U-joint of the adjustment mechanism is firmly attached to a neck block that is attached within the body of the instrument between the back plate and the top plate. When the neck is attached to the body of the instrument a screw which is captive within the U-joint is threadably inserted in a threaded aperture of the T-rail. A wider portion of the T-rail closely fits within a bottom wider portion of the U-joint providing close tolerance but still a sliding fit between the two elements of the adjustment mechanism. If the hex wrench is turned in a counterclockwise motion the screw attached to the U-joint will disengage from the threaded aperture of the T-rail thereby releasing the neck from the body of the instrument. This action allows the neck and the body to be transported in a smaller instrument case for travel purposes. A clamp bushing within the U-joint permits linear movement of the T-rail when the hex wrench is rotated by keeping the U-joint fixed within the body of the instrument. The U-joint may be attached to the body of the instrument and the neck block by means of multiple screw fasteners. Additionally, the T-rail may be attached to the tongue by means of similar screw fasteners.

As can be seen in the drawings, motion of the neck and T-rail permits the finger board and strings to move in a direction perpendicular to the U-joint and body of the instrument. Consequently no adjustment to the bridge of the instrument is required. Additionally, acoustic instruments swell and relax according to humidity changes, traditionally requiring bridge adjustments and in some cases the fitting of different seasonal bridges. This system eliminates the need for constant bridge adjustment, as the string heights can be finally tuned from the body with a twist of the hex wrench. This adjustment is also useful as different string heights are desired for different styles of music. This string height adjustment can be set easily even over the course of a musical performance.

As described, the neck can be fully unscrewed from the body and packed separately in a case designed for a smaller body profile. In the case of an acoustic double bass the space savings of two or three feet is provided. This interlocking neck mechanism makes reattachment and fit simple and repeatable with the advantage of durability of the machined metal components, specifically the U-joint and T-rail. Other versions of prior art have incorporated wood which can swell, bind and deteriorate over time.

Finally, this mechanism and installation can be utilized on an existing traditional instrument where the instrument has not been purposely built as a travel instrument. This adjustable mechanism installation can be easily made as a retrofit to a variety of instruments, the adjustment screw head is hidden from sight and the U-joint is hardly visible.

DETAILED DESCRIPTION

The following description will be for a stringed bass instrument but the same concepts, description and drawings are applicable to violins, violas and cellos in the violin family.

Figure 1:
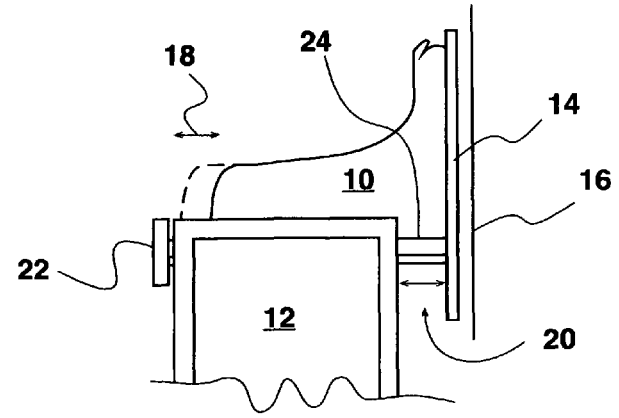
FIG. 1 is a side section view of the neck and body of a bass violin.

Referring to FIG. 1, neck 10 is installed on body 12 of the bass violin. Attached to the neck is fingerboard 14 and strings 16. In this view neck 10 has been moved away from the body as shown by arrow 18 which has moved fingerboard 14 away from the body 12 as shown by arrow 20. Movement of the neck is accomplished by rotation of tool 22 which is temporarily inserted into body 12. It can be seen on this figure that the sliding movement is perpendicular to the fingerboard 14 allowing movement of the strings and fingerboard down without any adjustment to the bridge of the instrument.

Figure 2:
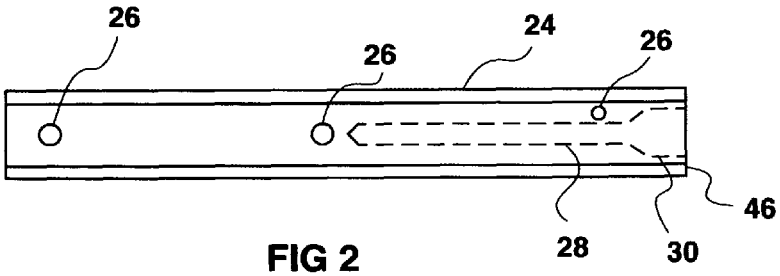
FIG. 2 is a plan view of the T-rail of the adjustment mechanism.
Figure 3:
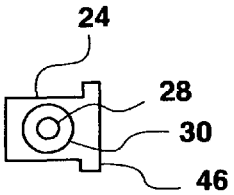
FIG. 3 is an end view of the T-rail.

FIG. 2 illustrates the plan view of the T-rail 24, a machined metal insert which is inserted within the neck 10 and held in place by fasteners inserted through apertures 26. Threaded aperture 28 is machined into the end of T-rail 24 and is provided with a countersink 30 as shown in FIG. 3.

Figure 5:
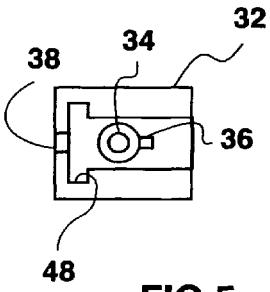
FIG. 5 is an end view of the U-joint.
Figure 4:
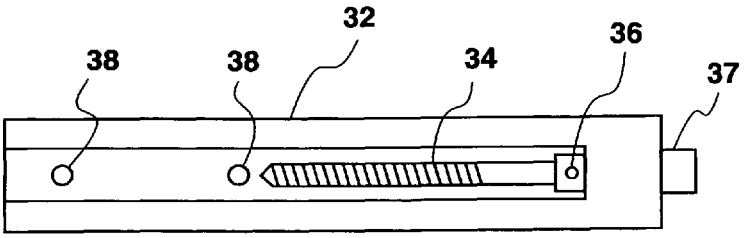
FIG. 4 is a plan view of the U-joint of the adjustment mechanism.

FIGS. 4 and 5 illustrate a U-joint 32, the other half of the adjustment mechanism. Adjustment screw 34 is held within the U-joint 32 by means of clamp bushing 36 and screwhead 37. U-joint 32 is fastened to the body of the bass violin by neck screws inserted through U-joint apertures 38.

Figure 6:
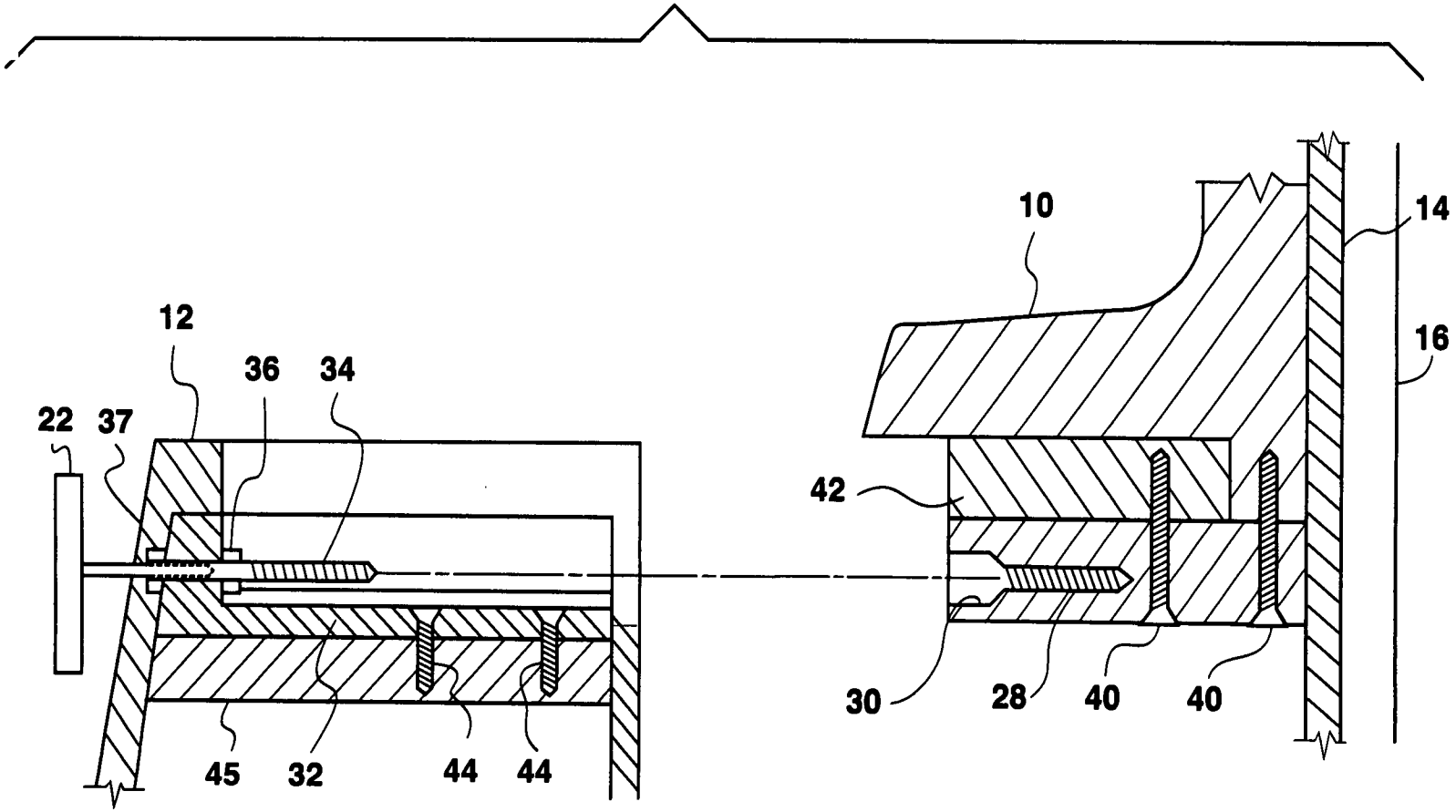
FIG. 6 is an exploded side section view of the neck and body of the bass violin with the adjustment mechanism installed.

FIG. 6 illustrates how the adjustment mechanism fits within the neck 10 and body 12 of the bass violin. Neck screws 40 holds the T-rail 24 to neck 10 and tongue 42. Body screws 44 hold the U-joint 32 into neck block 45. When the neck 10 is installed over the body 12 the adjustment screw 34 is threaded into threaded aperture 28. At the same time a wider portion 46 of the T-rail 24 closely fits within bottom portion 48 of the U-joint 32 thereby providing a close tolerance but sliding fit between the two machined elements of the adjustment mechanism. It can be seen that when the neck and T-rail is slid within the U-joint and body the adjustment screw 34 will engage the threaded aperture 28 in the U-joint 32. Insertion of hex wrench 50 into the end of adjustment screw 34 permits threading of the adjustment screw 34 into the T-rail 24 thereby causing the neck 10 to be inserted farther within the body 12 when wrench 50 is turned clockwise. Conversely, counterclockwise motion disengaged the neck 10 from the body 12. Linear movement of the adjustment screw 34 within U-joint 32 is prevented by the captive action of the clamp bushing 36 thereby causing the motion of the neck 10 relative to the body 12.

The adjustment mechanism described above allows both moving the neck relative to the body for adjustment purposes or total removal of the neck from the body with a single tool. Careful machining of the two elements in this mechanism provide for a tight neck to body connection while still providing for sliding motion and total removal of the instrument neck from the body for transport.

The invention claimed is:

1. I claim an improved adjustable and removable string instrument mechanism for stringed instruments, the improvement comprising;

(a) an instrument neck;

(b) a tongue affixed within the instrument neck;

(c) a T-rail fixed to the tongue, the T-rail having a threaded aperture;

(d) an instrument body;

(e) a neck block affixed within the instrument body;

(f) a U-joint affixed to the neck body, the U-joint having a screw, screw head and clamp bushing;

wherein rotation of the screw within the threaded aperture moves the neck relative to the body and further rotation permits disengagement of the screw from the threaded aperture thereby removing the neck from the body.

2. The mechanism of claim 1 wherein the screw is rotated by a wrench inserted in the end of the screw.

3. The mechanism of claim 1 wherein the T-rail and the U-joint are carefully machined metal mechanisms thereby providing a sliding fit between a wider portion of the T-rail within a wider bottom portion of the U-joint.

4. The mechanism of claim 1 wherein the clamp bushing and and screw head prevent linear motion of the screw during rotation of the screw.

5. The mechanism of claim 1 wherein the tongue, T-rail and U-joint are designed to be installed in an existing stringed instrument.

6. The mechanism of claim 1 wherein the instrument is a bass violin.

7. The mechanism of claim 1 wherein the instrument is a viola.

8. The mechanism of claim 1 wherein the instrument is a violin.

9. The mechanism of claim 1 wherein the instrument is a guitar.

* * * * *